US006402602B1

(12) United States Patent
Garcia et al.

(10) Patent No.: US 6,402,602 B1
(45) Date of Patent: Jun. 11, 2002

(54) ROTARY UNION FOR SEMICONDUCTOR WAFER APPLICATIONS

(75) Inventors: John Garcia, Morgan Hill, CA (US); Andrew Yednak, III, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/754,510

(22) Filed: Jan. 4, 2001

(51) Int. Cl.[7] ..... B24B 5/00; B24B 47/02

(52) U.S. Cl. ..... 451/398; 451/287; 451/288

(58) Field of Search ..... 451/41, 177, 259, 451/270, 271, 268, 269, 285, 287, 288, 364, 397, 398, 490

(56) References Cited

U.S. PATENT DOCUMENTS

| | | | | |
|---|---|---|---|---|
| 4,974,370 A | 12/1990 | Gosis | 51/111 R |
| 5,036,625 A | 8/1991 | Gosis | 51/131.1 |
| 5,095,661 A | 3/1992 | Gill, Jr. et al. | 51/131.3 |
| 5,099,614 A | 3/1992 | Arai et al. | 51/165 R |
| 5,443,416 A | 8/1995 | Volodarsky et al. | 451/388 |
| 5,498,196 A | 3/1996 | Karlsrud et al. | 451/11 |
| 5,498,199 A | 3/1996 | Karlsrud et al. | 451/289 |
| 5,527,209 A | 6/1996 | Volodarsky et al. | 451/388 |
| 5,738,574 A | 4/1998 | Tolles et al. | 451/288 |
| 5,804,507 A | 9/1998 | Perlov et al. | 438/692 |
| 5,941,758 A | 8/1999 | Mack | 451/41 |
| 5,951,373 A | 9/1999 | Shendon et al. | 451/41 |
| 6,019,671 A | 2/2000 | Shendon | 451/56 |
| 6,062,961 A | 5/2000 | Can | 451/385 |
| 6,068,549 A | 5/2000 | Jackson | 451/398 |
| 6,080,046 A | 6/2000 | Shendon et al. | 451/54 |
| 6,083,089 A | 7/2000 | Breivogel et al. | 451/287 |
| 6,126,517 A | 10/2000 | Tolles et al. | 451/41 |

*Primary Examiner*—Derris H. Banks
(74) *Attorney, Agent, or Firm*—James L. Farmer

(57) ABSTRACT

A rotary union is provided for chemical mechanical polishing of silicon wafers, especially silicon wafers containing chemically sensitive integrated circuit structures. A rotary union is provided with a union rotor and union stator, coupled at the free end of a support spindle carrying a CMP polishing table. In the preferred embodiment the rotary union is joined to a coolant union forming the lower end of the support spindle. A passageway through the union rotor extends past the bottom end of the coolant union rotating part to avoid contact of fluid transmitted through the passageway formed in the union rotor, with the rotating part of the coolant union.

20 Claims, 4 Drawing Sheets

ROTARY UNION FOR SEMICONDUCTOR WAFER APPLICATIONS

BACKGROUND OF THE INVENTION

1. Field of the Invention

The present invention pertains to rotary unions for semiconductor wafer applications, such as chemical/mechanical polishing. In particular, the present invention pertains to such rotary unions which conduct a supply of "ultra pure" water which contacts the semiconductor wafer and must therefore be chemically compatible with the semiconductor wafer.

2. Description of the Related Art

Silicon wafers are typically employed for the mass production of commercially important integrated circuits. A plurality of integrated circuit devices are formed on a silicon wafer substrate, layer by layer, and chemical/mechanical polishing (CMP) must be performed on the wafer, between layering steps. Layering is typically carried out using photolithographic techniques which require an accurately flat surface.

Planarization of silicon wafers provides the high degree of flatness required for integrated circuit fabrication using photolithographic techniques. The active surface of the wafer substrate is placed in contact with a rotating polishing pad in the presence of various chemical agents which can include deionized water, etchants and polishing slurries. The polishing of commercially significant silicon wafers can include a more aggressive material removal process in which a slurry of polishing particles includes a chemically reactive agent. While it is desirable to polish a semiconductor wafer as quickly as possible in order to obtain the desired flatness or planarization, it is important that the over polishing be avoided. This requires a constant or near constant monitoring of the polishing process.

One type of polish monitoring employed today uses optical and other types of sensors embedded in a polish table. As mentioned, slurries and other types of chemical mixtures are employed in chemical/mechanical polishing and other types of wafer treatments. Typically, the polish table is flooded with slurry which also covers or otherwise interferes with the monitoring instrumentation. Accordingly, it is customary to wash the active face of the monitoring instrumentation which may comprise, for example, the free ends of optical wave guides embedded in the polish table. A flushing medium is employed to displace slurry or other wafer treatment chemicals from the active surface of the monitoring instrumentation.

In addition to flushing away material from the active face of the monitoring instrumentation, the flushing media must be compatible with the semiconductor wafer in all respects, especially in the sense of being chemically compatible with the wafer substrate and the integrated circuit structures built on the water substrate. Water is frequently chosen as the flushing medium since it is relatively inert in many respects. However, even "pure" water must be treated to attain very high levels of chemical inertness with regard to the semiconductor wafer and the term "ultra pure" has been applied to describe these special requirements. In order to maintain its ultra pure qualities, even brief incidental contact with metallic components must be avoided.

As mentioned, chemical/mechanical polishing is carried out using a polishing table and accordingly a rotating support shaft is customarily employed. In addition, devices used to contact the wafer with the polishing pad are also rotationally driven. These types of wafer-holding devices, usually termed wafer carriers, oftentimes are called upon to supply a fluid as part of the wafer treatment process. Thus, fluid communication must be maintained between the rotating wafer carrier and an external, non-rotating source.

Rotary unions, such as those described in U.S. Pat. No. 5,443,416 provides continuous fluid communication between a fluid source and a fluid chamber associated with the rotating wafer carrier. Although similar in some respects, a rotating polish table is much more massive than typical wafer carriers, and is subjected to much greater forces. If a rotary union is to be provided with fluid communication, a different type of arrangement from those employed in wafer carriers is needed. And, if a rotary union of a polish table is required to provide continuous fluid communication, different arrangements, other than those employed with wafer carriers, must be provided. Solutions to these and other problems attendant with polish table used in chemical/mechanical polishing are continually being sought.

SUMMARY OF THE INVENTION

It is an object of the present invention to provide a rotating union for a polish table used in chemical/mechanical polishing of semiconductor wafers.

Another object of the present invention is to provide a rotary union of the above type which provides a continuous fluid communication from a remote stationary fluid source to the polishing table and semiconductor wafers.

A further object of the present invention is to provide rotating union of the above-described type which maintains the desired condition of ultra pure fluids, such as ultra pure water, as it flows through the rotary union to eventually contact directly or indirectly, a semiconductor wafer being treated on the polishing table.

These and other objects according to principles of the present invention are provided in a rotary union for mounting to a rotating element which has an element bore wall defining an element bore of preselected size. The rotary union maintains semiconductor wafer treatment fluids in an ultra pure condition and comprises a union stator having a support face, a union rotor having a support face and an opposed mounting face adjacent the rotating element and at least one mount for movably mounting the union rotor toward and away from the rotating element. The union rotor defines a union bore of smaller size than said element bore, a spring bias between said union rotor mounting face and said rotating element, biasing said union rotor away from said rotating element, and a face seal between said union stator support face and said the union rotor support face, said face seal in the form of a flat washer and comprised of expanded TEFLON material. The union rotor also defines a passageway for the semiconductor wafer treatment fluids, said passageway extending from said union rotor support face to a portion of said union rotor mounting face radially interiorly of said element bore wall.

Other objects according to principles of the present invention are attained in a rotary union for mounting to a metallic rotating element which has an element bore wall defining an element bore of preselected size. The rotary union maintains semiconductor wafer treatment fluids in an ultra pure condition and comprises a union stator having a support face, a union rotor having a support face and an opposed stepped mounting face adjacent the rotating element, the union stator and the union rotor of nonmetallic composition which maintains semiconductor wafer fluids in an ultra pure condition, and a plurality of elongated fasteners movably mounting the union rotor toward and away from the rotating element. The union rotor defines a union bore of smaller size than said element bore, a spring bias between said union rotor mounting face and said rotating element, biasing said union rotor away from said rotating element, and a face seal between said union stator support face and said the union rotor support face, said face seal in the form of a flat washer and comprised of expanded TEFLON material. The union rotor defines a passageway for the semiconductor wafer treatment fluids, said passageway extending from said union rotor support face to a portion of said union rotor mounting face radially interiorly of said element bore wall.

DETAILED DESCRIPTION OF THE PREFERRED EMBODIMENT

Figure 1:
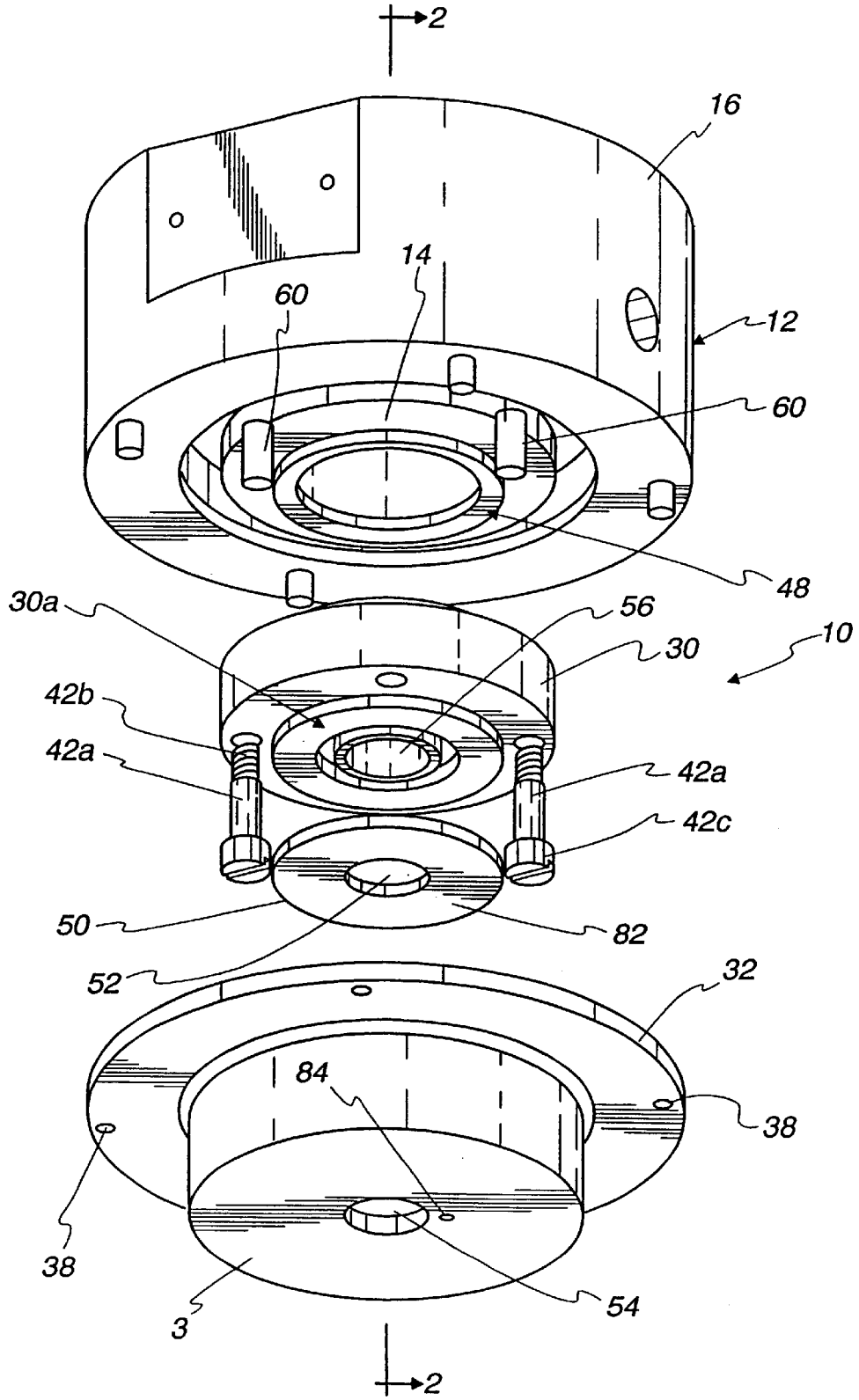
FIG. 1 is an exploded perspective view of a rotary union according to principles of the present invention.
Figure 2:
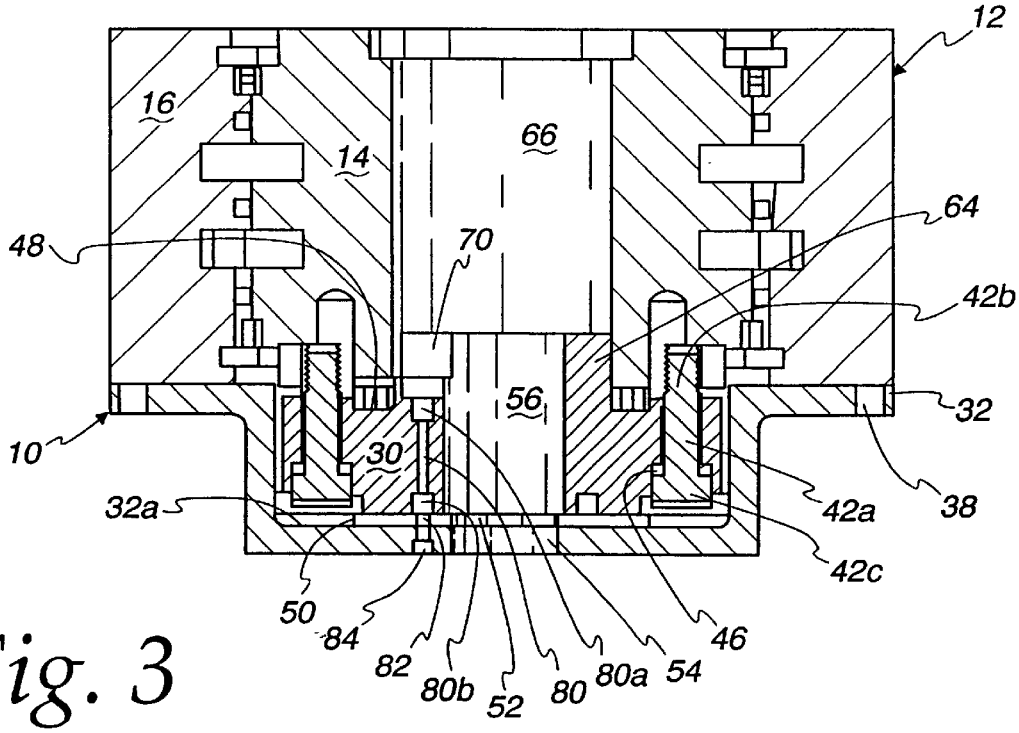
FIG. 2 is a cross-sectional view taken along the line 2—2 of FIG. 1.

Referring now to the drawings, and initially to FIGS. 1 and 2, a rotary union 10 according to principles of the present invention is shown in combination with a coolant union 12 having a rotor portion 14 and a stator portion 16. The coolant union 12 is supported from above by a polish table supporting spindle assembly 20 which includes a rotating spindle portion 22 and a stationary spindle portion 24 (see FIG. 3). As will be described. below, it has been found convenient to secure rotary union 10 to coolant union 12. The rotary union 10 could also be connected directly to spindle assembly 20, if desired, and such is contemplated by the present invention. When the rotary union 10 is fit to the spindle shaft, support bearings could be provided between the rotor and stator members 30, 32 of rotary union 10. If desired, rotary union 10 could also be fit to a fluid distribution manifold.

Figure 3:
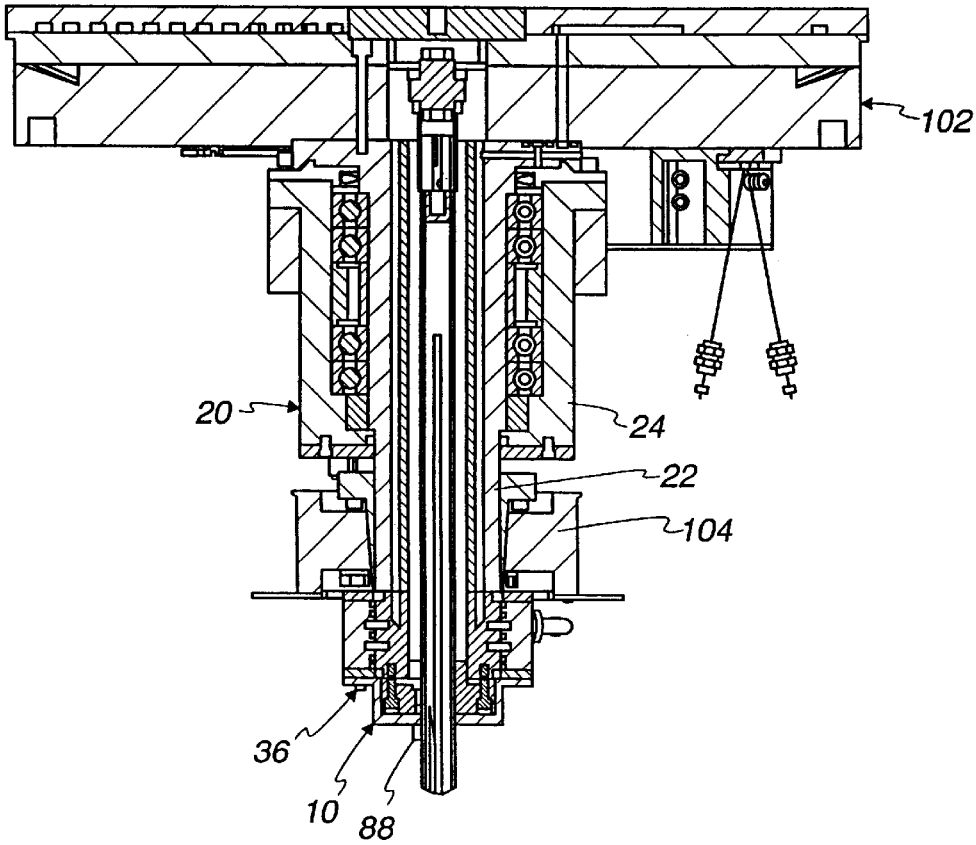
FIG. 3 is a cross-sectional view of a rotating polish table and the rotary union of FIG. 2.

Turning now to FIGS. 1–3, rotary union 10 comprises a rotating part or union rotor 30 and a stationary part or union stator 32. As shown in FIG. 3, threaded fasteners 36 extend through holes 38 (see FIG. 2) to secure union stator 32 to the stationary part 16 of coolant union 12. Referring to FIGS. 1 and 2, threaded fasteners 42 having threaded portions 42*b* and shoulder portions 52*a* secure union rotor 30 to the rotating part 14 of coolant union 12. Preferably, fasteners 42 comprise shoulder bolts with shoulders dimensioned sufficiently long as to permit union rotor 30 to reciprocate back and forth along shoulder portions 42*a*, as schematically indicated in FIG. 2 by a spacing 46 between shoulder portion 42*a* and enlarged head 42*c* of fastener 42. Fasteners 42 function as a mount for movably mounting union rotor 30 toward and away from rotating part 14 of coolant union 12. A spring member 48 is located between rotating part 14 of coolant union 12 and union rotor 30, so as to bias union rotor 30 in a direction away from rotating part 14 urging a lower face 30*a* of union rotary 30 toward an opposing inner face 32*a* of union stator 32.

Disposed between opposed faces 30*a* and 32*a* of union rotor 30 and union stator 32 is a face seal 50 having the form of a flat washer or disk with a central aperture 52 generally co-extensive with a central aperture 54 of union stator 32. As can be seen in FIG. 2, these apertures are generally co-extensive with an aperture 56 defined by rotating part 14 of coolant union 12. Referring to FIG. 1, guide pins 60 in rotating part 14 of coolant union 12 align union rotor 30 to coolant union 12. Alignment between the rotating part of coolant union 12 and union rotary 30 is also provided by a step portion 64 formed at the upper end of union rotor 30 dimensioned so as to be received in a central bore 66 defined by rotating part 14 of the coolant union.

Figure 4:
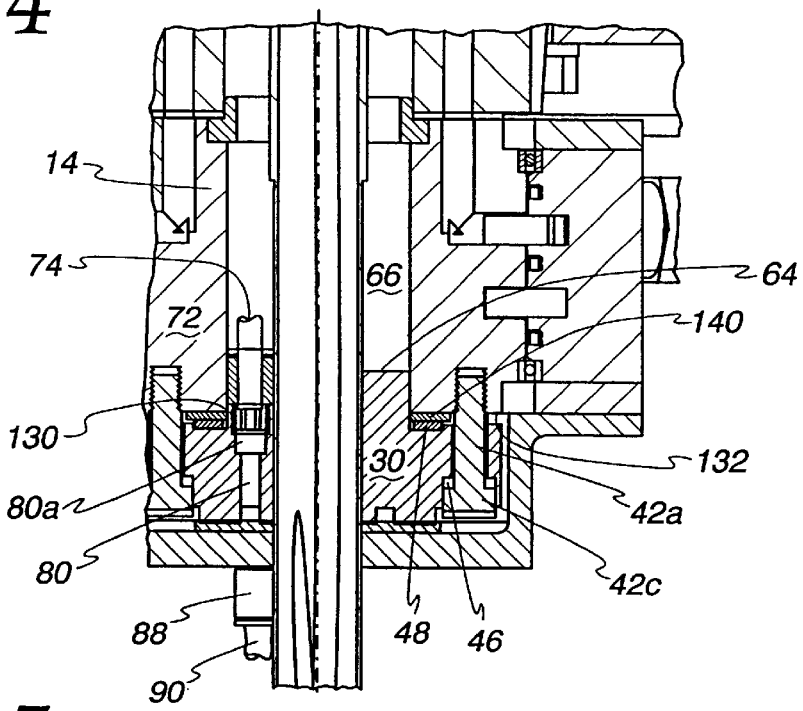
FIG. 4 is a fragmentary view of the bottom portion of FIG. 3, taken on an enlarged scale.

As can be seen, for example, in FIGS. 2 and 4, step portion 64 includes a recess or socket portion 70 for receiving a quick connect fitting 72 of a flexible water tube 74 (see FIG. 4). With reference to FIG. 2, recess 70 forms part of a passageway 80 which extends through union rotor 30, having an enlarged portion 80*a* at one end and an annular channel 80*b* at the other end. As can be seen in FIG. 2, passageway 80 is aligned with a passageway 82 in face seal 50 and a passageway 84 in union stator 32. A groove 86 formed in the interior surface of union stator 32 communicates with passageway 84. With reference to FIG. 4, a quick connect fitting 88 provides connection between an external fluid supply 90 and a connection to passageway 80. It is generally preferred that face seal 50 be secured to union stator 32 using adhesives or other conventional securement arrangements. Thus, the surface of union rotary 30 defining annular channel 80*b* wipes across the upper face of seal 50. If desired, the arrangement could be reversed, with face seal 50 secured to union rotor 30 and an annular groove formed in union stator 32, communicating with passageway 84. In either event, it is generally preferred that wear on face seal 50 be limited to one of its two major surfaces. As a less preferred alternative, face seal 50 could be made to move freely about both of its major surfaces.

Figure 5:
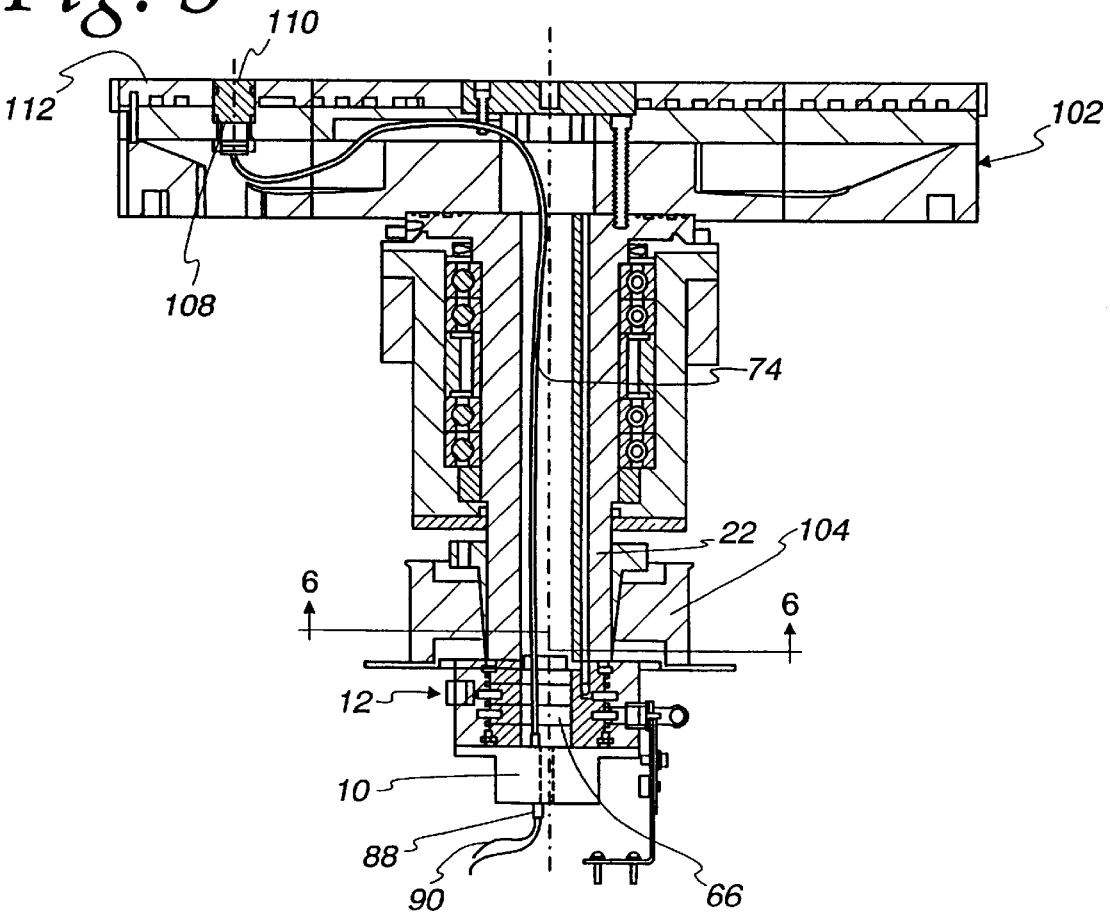
FIG. 5 is a cross-sectional view similar to that of FIG. 3, but showing additional features of a monitoring instrumentation system.

With reference to FIGS. 3 and 5, a polish table assembly 102 is mounted atop rotating spindle portion 22 and is rotatably driven therewith, by a drive belt connected to drive sprocket 104. Included in polish table 102 is polish monitoring instrumentation 108 which. comprises conventional polish monitoring instrumentation, such as optical end point determination equipment. As indicated in FIG. 5, a face 110 of polish monitoring instrumentation 108 is aligned with face 112 of polish table assembly 102. Included on face 112 is a conventional polish pad (not shown).

Figure 6:
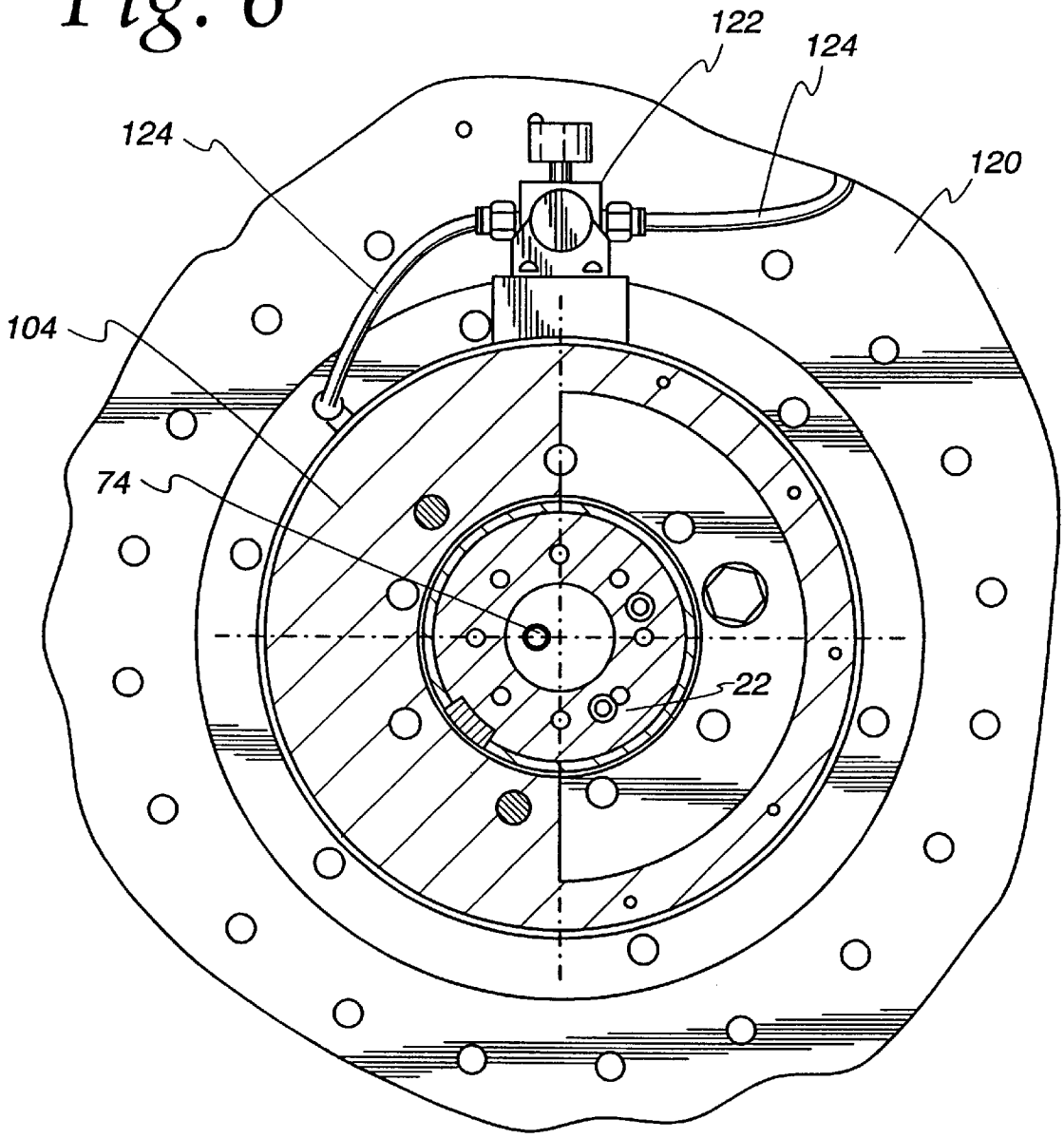
FIG. 6 is a cross-sectional view taken along the line 6—6 of FIG. 5.

In use, polish table face 112 is covered with slurry or other CMP polishing media. In order to maintain the face 110 of instrumentation 108 in an operational condition, face 110 is flushed with suitable flushing media, such as ultra pure water which is fed to surface 110 by flexible tube 74, which is connected to union rotor 30 as explained above with reference to FIG. 4. A supply of flushing medium is transported from an external source 90, thorough channel 80 in union rotor 30 so as to be received in flexible tube 74. Thus, during rotation of table assembly 194, face 110 of instrumentation 108 is maintained in an operational (that is, optically unobstructed) condition, with a continuous or intermittent flow of flushing agent. With reference to FIG. 6, the underside of the polish table is indicated at 120. A manifold arrangement 122 and tubing 124 distributes flushing media to selected points about the polish table to provide flushing for multiple instrumentation locations.

In order to maintain the fluid traveling through rotary union 10 in an ultra pure (fully wafer-compatible) condition, as described, the fluid passageway is maintained separate from contaminating materials such as the rotation part 14 of coolant union 12, which is preferably made of a metallic composition. It has been found, for example, that even if the rotating part 14 is made of traditionally "pure" materials such as various stainless steel compositions, some silicon wafer chemistries will be negatively impacted if contacted by ultra pure water which even briefly-touches metallic rotating part 14 on its path toward the surface of polish table assembly 102. Accordingly, as can be seen for example in FIGS. 2 and 4, care is taken to maintain passageway 80 entirely within union rotary 30 and to extend passageway 80 beyond (i.e., downstream of) the lower face of rotating part 14 of coolant union 12. As mentioned above, recess 70 (see FIG. 2) is provided to receive a quick connector for flexible tube 74, shown installed in FIG. 4. As can be seen for example in FIG. 4, a wall portion 130 of union rotor 30 separates the fluid passageway from the lower surface 132 of rotating part 14.

Chemicals, such as a flushing media, coming into contact with the wafer circuits pass through the union rotor 30 before coming into contact with its surfaces. As seen above, the fluid pathway extends through union rotor 30 which provides shielding from potentially incompatible materials conventionally employed in polish table spindle arrangements. Union rotor 30 can be readily manufactured with a minimum number of conventional machining steps which can be employed with a wide variety of materials. A particular advantage of the present invention is that different materials can be readily substituted for the union rotor 30 without a substantial increase in manufacturing costs. Thus, the present invention contemplates that different materials may be used for the fluid passageway, as may be dictated by so-called "wafer chemistries"(a term which refers, for example, not only to chemical interactions with the silicon wafer substrates, but also the integrated circuit structures deposited thereon). Recently, metallic circuits have been formed using copper alloys and other materials which require a strict chemical regimen in order to avoid undesirable effects, such as corrosion.

If subsequent operational changes raise issues of chemical compatibility, union rotor 30 can be quickly and easily fabricated from a different candidate material, thus expediting further testing and evaluation. In the preferred embodiment, union rotor 30 is of monolithic construction, made from PET (polyethylene terephthalate) also known as ERTALYTE. This union rotor material has been chosen for its compatibility with chemical/mechanical polishing of wafer compositions of current commercial interest. While it is generally preferred that union rotor 30 be made of non-metallic materials, it will be appreciated that a wide variety of materials chosen according to their chemical compatibility with wafer substrate and associated integrated circuit structures.

As can be seen for example in FIGS. 2 and 4, it is also important that face seal 50 be compatible with fluids contacting the wafer substrate and its structures. Additionally, face seal 50 must provide the wear characteristics and low friction qualities necessary for rotational sealing of the union rotor with respect to the union stator. In the preferred embodiment, face seal 50 is made of expanded PTFE material and most preferably is made of type GR PTFE material commercially available from GORE-TEX Corporation. The GORE-TEX type GR material has been found to be sufficiently inert for current commercial "ultra pure" water applications. That is, this material was found to be chemically compatible and non-contaminating with respect to commercially significant silicon wafers and integrated circuit structures in use today. Further, the GORE-TEX type GR material was found to be sufficiently hydrophobic, contributing also to the heightened level of cleanliness required for ultra pure applications. The chosen material was also found to be very lubricious when employed in the manner indicated.

Over extended use, face seal 50 is prone to wear, so as to take on a reduced thickness. Springs 58 urge union rotor 30 to apply pressure against the face seal 50, so as to maintain its desired operating characteristics, despite wear. Referring to FIG. 4, spring 48 preferably comprises a conventional wave spring made of medium steel material. If desired, the wave spring 48 could be replaced by conventional compression springs disposed about the fasteners 42. It has been found preferable to "back up" spring 48 with a washer 140. Although the rotary part of fluid union 12 and the union rotor 30 could be dimensioned for an accurate fit with regard to a selected spring 48, it has been found convenient to enlarge the spacing provided for spring 48 and to fill the space with one or more washers 140, thereby providing a convenient arrangement for controlling the end play and related forces exerted on face seal 50. The aforementioned GORE-TEX type GR material held its desired shape and lubricious properties under extended wear conditions associated with relatively massive turntable operations.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A rotary union for mounting to a rotating element having an element bore wall defining an element bore of preselected size, the rotary union maintaining semiconductor wafer treatment fluids in an ultra pure condition, the rotary union comprising:

a union stator having a support face;

a union rotor having a support face and an opposed mounting face adjacent the rotating element;

at least one mount for movably mounting the union rotor toward and away from the rotating element;

the union rotor defining a union bore of smaller size than said element bore;

a spring bias between said union rotor mounting face and said rotating element, biasing said union rotor away from said rotating element;

a face seal between said union stator support face and said the union rotor support face, said face seal in the form of a flat washer and comprised of expanded PTFE material; and said union rotor defining a passageway for the semiconductor wafer treatment fluids, said passageway extending from said union rotor support face to a portion of said union rotor mounting face radially interiorly of said element bore wall.

2. The rotary union of claim 1 wherein the union rotor mounting face is stepped to form a collar portion extending into said element bore wall, and said passageway extending through said collar portion so as to be isolated from said element bore wall.

3. The rotary union of claim 2 wherein said collar portion includes a recess for receiving a flexible tubing.

4. The rotary union of claim 1 wherein said face seal is made of and expanded PTFE material.

5. The rotary union of claim 1 wherein said union rotor and said union stator are made of Polyethylene Terephthalate material.

6. The rotary union of claim 1 wherein said spring bias comprises a spring in the form of a wave washer.

7. The rotary union of claim 1 wherein said at least one mount comprises a shoulder bolt, and wherein said union rotor is free to slide along a shoulder portion of the shoulder bolt.

8. The rotary union of claim 1 wherein said union rotor defines pin recesses for receiving alignment pins extending from said element.

9. The rotary union of claim 1 wherein said rotating element is metallic.

10. A rotary union for mounting to a metallic rotating element having an element bore wall defining an element bore of preselected size, the rotary union maintaining semiconductor wafer treatment fluids in an ultra pure condition, the rotary union comprising:

a union stator having a support face;

a union rotor having a support face and an opposed stepped mounting face adjacent the rotating element;

the union stator and the union rotor of nonmetallic composition which maintains semi conductor wafer fluids in an ultra pure condition;

a plurality of elongated fasteners movably mounting the union rotor toward and away from the rotating element;

the union rotor defining a union bore of smaller size than said element bore;

a spring bias between said union rotor mounting face and said rotating element, biasing said union rotor away from said rotating element;

a face seal between said union stator support face and said the union rotor support face, said face seal in the form of a flat washer and comprised of expanded PTFE material; and said union rotor defining a passageway for the semiconductor wafer treatment fluids, said passageway extending from said union rotor support face to a portion of said union rotor mounting face radially interiorly of said element bore wall.

11. The rotary union of claim 10 wherein the union rotor mounting face is stepped to form a collar portion extending into said element bore wall, and said passageway extends through said collar portion so as to be isolated from said element bore wall.

12. The rotary union of claim 11 wherein said collar portion includes a recess for receiving a flexible tubing.

13. The rotary union of claim 10 wherein said union rotor is made of Polyethylene Terephthalate material.

14. The rotary union of claim 10 wherein said union rotor and said union stator are made of Polyethylene Terephthalate material.

15. The rotary union of claim 10 wherein said spring bias comprises a spring in the form of a wave washer.

16. The rotary union of claim 10 wherein said mount comprises a shoulder bolt having a shoulder portion, and said union rotor is free to slide along a shoulder portion of the shoulder bolt.

17. The rotary union of claim 10 wherein said union rotor defines pin recesses for receiving alignment pins extending from said element.

18. The rotary union of claim 10 wherein said element is metallic.

19. The rotary union of claim 10 wherein said face seal is comprised of an expanded PTFE material.

20. The rotary union of claim 10 wherein said metallic rotating element comprises a rotor of a coolant union coupled to a support spindle supporting a polishing table.

* * * * *